US005116488A

United States Patent [19]

Torregrossa

[11] Patent Number: 5,116,488

[45] Date of Patent: May 26, 1992

[54] GAS SPARGED CENTRIFUGAL DEVICE

[75] Inventor: Louis O. Torregrossa, Glens Falls, N.Y.

[73] Assignee: Kamyr, Inc., Glens Falls, N.Y.

[21] Appl. No.: 573,978

[22] Filed: Aug. 28, 1990

[51] Int. Cl.[5] ..... B03D 1/14; B03D 1/24; B04C 5/10; B04C 5/107

[52] U.S. Cl. ..... 209/170; 209/211; 210/512.1; 210/221.2; 261/122

[58] Field of Search ..... 209/170, 211; 210/512.1, 512.2, 221.2; 261/122

[56] References Cited

U.S. PATENT DOCUMENTS

| | | | |
|---|---|---|---|
| 2,532,885 | 12/1950 | Berges | 92/28 |
| 3,391,787 | 7/1968 | Salomon | 210/84 |
| 3,489,680 | 1/1970 | Snavely, Jr. | 210/23 |
| 3,759,385 | 9/1973 | Pouillon | 209/165 |
| 4,094,783 | 6/1978 | Jackson | 210/221.2 |
| 4,134,827 | 1/1979 | Frykhult | 209/211 |
| 4,252,640 | 2/1981 | Musselmann | 209/211 |
| 4,279,743 | 7/1981 | Miller | 209/211 |
| 4,397,741 | 8/1983 | Miller | 209/170 |
| 4,399,027 | 8/1983 | Miller | 209/164 |
| 4,744,890 | 5/1988 | Miller et al. | 209/164 |
| 4,838,434 | 6/1989 | Miller et al. | 209/164 |
| 4,876,016 | 10/1989 | Young | 210/512.1 |
| 4,919,796 | 4/1990 | Vikio | 209/211 |
| 4,971,685 | 11/1990 | Stanley | 209/170 |
| 4,997,549 | 3/1991 | Atwood | 209/170 |

FOREIGN PATENT DOCUMENTS

| | | | |
|---|---|---|---|
| 275365 | 8/1964 | Australia . | |
| 198737 | 10/1986 | European Pat. Off. | 209/170 |
| 3524071 | 1/1987 | Fed. Rep. of Germany | 209/170 |
| 545385 | 3/1977 | U.S.S.R. | 209/170 |

*Primary Examiner*—Stanley S. Silverman
*Assistant Examiner*—Thomas M. Lithgow
*Attorney, Agent, or Firm*—Nixon & Vanderhye

[57] ABSTRACT

A hydrocyclone establishes a first vortex of fluent material at one end (e.g. in a top portion), and a second vortex at the other end (e.g. in a bottom portion). The first vortex is established within a porous surface of revolution to which gas or other fluid is supplied, passing through the porous surface into the first vortex. The second vortex is established by a conical end section extending outwardly from (e.g. below) the porous surface, and with an axial (e.g. bottom) discharge for fluent material. Some fluent material—for example having heavy particles—is removed tangentially from the conical end section at a portion near the porous surface of revolution. A conical shroud having a circumferential periphery is mounted by a number of spaced legs connected between the shroud and the conical bottom section so that fluent material may pass between the circumferential periphery of the shroud and the porous surface of revolution. An axial gas passage is provided in the shroud to allow gas to escape from the second vortex into the first vortex, and ultimately out the first end (e.g. top) of the hydrocyclone. A plenum surrounding the porous surface of revolution may be divided into two or more axial portions, and liquid can be introduced into one of the plenum portions so that it experiences a pressure drop as it passes through the porous surface of revolution, thereby causing small bubbles to form.

15 Claims, 2 Drawing Sheets

GAS SPARGED CENTRIFUGAL DEVICE

BACKGROUND AND SUMMARY OF THE INVENTION

There are many emerging uses for gas sparged hydrocyclones in the treating of fluent materials in general, particularly liquid slurries and liquids.

In a gas sparged hydrocyclone, such as shown in U.S. Pat. Nos. 4,279,743, 4,399,027, and 4,838,434, the fluent material is introduced into a hollow body to establish a vortex, and gas is sparged through a porous surrounding wall into the vortex. Gas, and elements carried thereby, are withdrawn from the center top portion of the vortex, while the fluent material is withdrawn from a bottom portion of the vortex. While the hydrocyclones illustrated in the above-identified patents are used solely for flotation, it has recently been established that the hydrocyclones are useful for many other processes, such as shown in co-pending application Ser. No. 07/573,975 filed Aug. 28, 1990, entitled "Gas Sparged Centrifugal Separation and/or Mixing", including effecting chemical treatment of solids in a slurry with a chemically reactive gas, scrubbing flue gases, chemically reacting a liquid with a gas, stripping a strippable component from a liquid utilizing a stripping gas, and absorbing a gas within an absorbable component in an absorbent liquid.

The present invention relates to a hydrocyclone, and a method of treating fluent material utilizing a hydrocyclone, to improve the versatility of existing gas sparged hydrocyclones, and in some circumstances the efficiency thereof.

According to one aspect of the present invention, a hydrocyclone is provided that has—in addition to the conventional components of a hollow body, inlet at a first end for fluent material establishing a first vortex within the hollow body, fluid withdrawing means from the first end (e.g. top) of the vortex, a porous surface of revolution disposed within the hollow body wall, and a plenum between the body wall and the porous surface of revolution—means for establishing further vortex action in a volume between the porous surface of revolution and the withdrawal means for fluent material. The second vortex is established by a conical bottom section of the hollow body extending from below the porous surface of revolution to the fluent material withdrawing means.

Desirably a shroud—such as a conical shroud —having a circumferential periphery is disposed above the conical bottom section, and intensifies the second vortex action. A plurality of legs, or like mounting means, mount the shroud so that fluent material may pass between the circumferential periphery of the shroud and the porous surface of revolution, but the mounting means does not disrupt flow patterns. A central axially extending gas passage is formed in the shroud allowing passage of gas separated in the conical bottom section to flow to the gas withdrawal means at the top of the first vortex. Some fluent material—particularly a heavier particle fractions of a slurry—may be tangentially withdrawn from the conical bottom section at a part thereof adjacent the porous surface of revolution.

According to another aspect of the present invention, a hydrocyclone is provided having—in addition to conventional components—a wall dividing the plenum into at least first and second axially spaced portions. A liquid may be introduced into one of the plenum portions, and the gas into the other, the liquid being introduced so that it has a pressure drop across the plenum so that gas therein (the liquid may be saturated with gas) will be released in small bubble form.

According to another aspect of the present invention, a method of acting upon fluent material is provided which comprises the following steps: (a) Introducing the fluent material into a first end of a first vortex. (b) Introducing fluid from exteriorly of the vortex into contact with the fluent material in the first vortex. (c) Removing some fluid from the first end of the first vortex. (d) After step (b), subjecting the fluent material to a second vortex action. And, (e) removing fluent material from the second end of the second vortex. There preferably is the step (f) of removing a portion of the fluent material (a slurry with heavy particles therein) tangentially from the first portion of the second vortex. There may be the still further step (g) of shrouding the central axis of the second vortex while allowing axial (e.g. upward) passage of gas from the central vortex to be withdrawn as fluid in step (c).

According to another aspect of the present invention, a method of treating fluent material is provided which comprises the following steps: (a) Introducing fluent material into a fluent material vortex within the porous surface of revolution. (b) From exteriorly of the vortex, introducing liquid through the porous wall into the vortex so that the liquid experiences a pressure drop as it passes through the porous wall. (c) Removing gas from the first end of the vortex. And, (d) removing treated fluent material from a second end of the vortex, opposite the first end.

Utilizing the apparatus and processes as set forth above, a wider variety of treatments can be given to fluent material, and/or the efficiency of existing treatments (such as flotation) may be enhanced.

It is the primary object of the present invention to provide hydrocyclones and procedures with improved versatility and/or efficiency compared to conventional gas sparged hydrocyclones and procedures utilizing the same. This and other objects of the invention will become clear from an inspection of the detailed description of the invention, and from the appended claims.

DETAILED DESCRIPTION OF THE DRAWINGS

Figure 1:
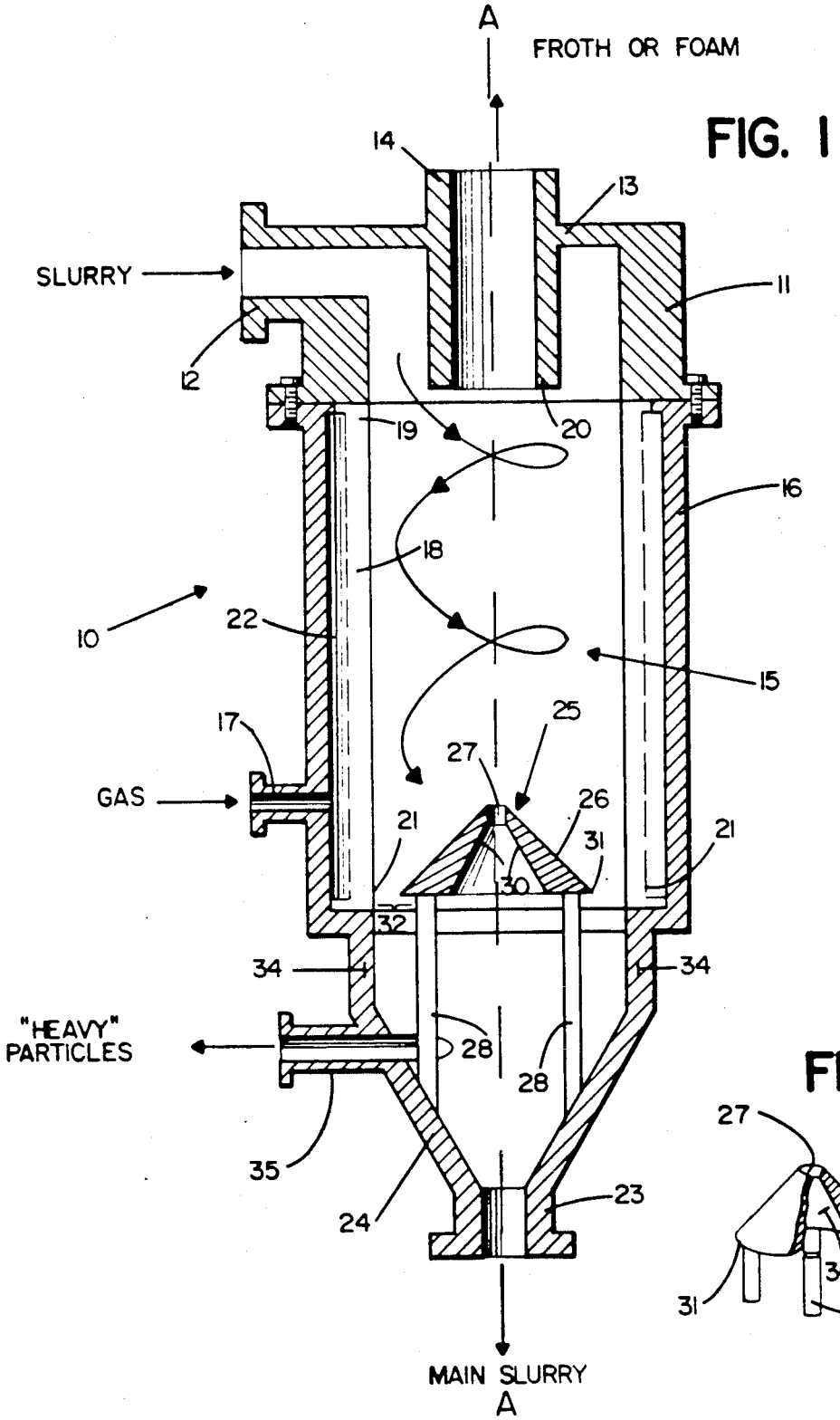
FIG. 1 is a side schematic cross-sectional view of an exemplary hydrocyclone according to the present invention.

An exemplary hydrocyclone according to one embodiment of the present invention is illustrated generally by reference numeral 10 in FIG. 1. The conventional components of the hydrocyclone include: A top portion 11 of a hollow body including a fluent material inlet 12, and a top surface 13 with a conduit 14 therein comprising a first means for withdrawing fluid (gas, froth, or foam) from the hydrocyclone 10. A main hollow body portion 16 is connected to the top portion 11, and includes an inlet 17 for the introduction of sparging fluid, such as gas, into the vortex 15 established within the body 16. Mounted within the wall 16 is a porous surface of revolution, for example a porous cylinder (as actually illustrated in FIG. 1), cone, or the like, having a top portion 19 adjacent the bottom 20 of the gas withdrawal conduit 14, and a bottom portion 21. A plenum 22 is defined between the hollow body wall 16 and the porous surface of revolution 18. The material of the porous surface of revolution 18 may be porous ceramic or plastic, sintered metal, or other material such as suggested in U.S. Pat. Nos. 4,279,743, 4,399,027, and 4,838,434. A second withdrawing means, outlet 23, is provided at the second end 21 of the porous surface of revolution 18, "treated" fluent material passing therethrough.

Normally the body 16, surface 18, and the like are symmetrical about a substantially vertical axis A—A, while the inlet 12 is tangential to impart the vortex action 15 to the fluent material. However the invention is in no way restricted to vertical axis vortices, and the terms "top" and "bottom" are to be understood as merely relative.

What has heretofore been described are basically conventional components of the gas sparged hydrocyclone. According to the present invention additional components are provided for increasing the versatility and/or efficiency of the hydrocyclone 10.

One of the features of the hydrocyclone 10 according to the invention is means for establishing a further vortex action in a volume between the bottom (second end) 21 of the porous surface of revolution 18, and the second withdrawal means or outlet 23, to effect separation of some or substantially all of the remaining gases in the fluent material when it reaches the bottom 21 of the porous surface of revolution 18. Such means preferably comprise the conical bottom (second end) section 24 (e.g. sharply tapered). A shroud means 25 is mounted in a particular association with the porous surface of revolution 18 and the conical end section 24. The shroud 25, which may comprise a conical body 26 having a central axially extending passage 27 therein, is mounted by legs 28 or like mounting means so that the porous surface of revolution 18 bottom (second end) surface 21 is just below (past) the circumferential periphery 31 of the shroud 25, and so an annular passage 32 is provided between the circumferential periphery of the shroud 25 and the porous surface of revolution 18. The legs 28 are designed so that they do not interfere with the flow of slurry or like fluent material from the first vortex 15 to the conical section 24, and so that the conical body 26 shields the outlet 23 from the fluent material and intensifies the vortex action of the fluent material within the conical bottom section 24. Note that the conical body 26 has a smaller diameter at the top (first end) than the bottom (second end) thereof, gradually increasing toward the conical section 24. Most desirably a conical interior passage 30 is provided within the shroud 26, also increasing in diameter as it approaches the conical bottom section 24, for collecting gas and channeling it through the central axial passage 27. Preferably a solid cylindrical section 34 is provided as an extension of porous member 18.

The hydrocyclone 10 can be used for a wide variety of methods of acting upon fluent materials, particularly slurries. The invention is particularly useful for minimizing foam carryover with the accepted slurry stream, very efficiently separates the gas, and allows some simultaneous separation of heavy weight particles in the slurry, for example separation of sand from comminuted cellulosic fibrous material (paper) pulp. Suction can be applied to conduit 14 if desired, or the device 10 can be pressurized (e.g. at above atmospheric pressure). A pipe with holes drilled in it may sometimes be used as the porous surface of revolution 18.

The slurry or other fluent material is introduced tangentially into the top (first end) 11 via the inlet 12, and moves in a vortex 15, in a spiral (e.g. downwardly) within the body 11, 16. Fluid, particularly gas, is introduced through conduit 17 into plenum 22 and passes through the porous surface of revolution 18 into the slurry in the vortex 15. The gas acts upon the slurry—in the case of flotation applications causing the hydrophobic particles to move upwardly in a foam to be discharged in gas/froth/foam withdrawal conduit 14—while the accepted slurry flows downwardly toward the outlet 23. As the slurry approaches the shroud 25, the shroud facilitates separation of the foam in the center portion of the vortex 15 from the slurry surrounding it, and intensifies the vortex action as the slurry flows through the annular passage 32 into the conical section 24, where it is subjected to further vortex action. The further vortex action in the conical portion 24 causes remaining gas to escape and move to the central axis A, collecting in the conical passage 30 and then passing through gas passage 27 axially (e.g. upwardly) into the main body 16, and ultimately out the conduit 14. The high density and larger particles, when subjected to the further vortex action in the conical section 24, move toward the wall where they are extracted through a generally tangential outlet nozzle 35. Approximately 5-25% of the slurry flow passes through the nozzle 35, while the balance exits the outlet 23.

Figure 2:
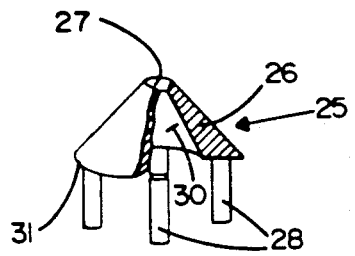
FIG. 2 is a perspective view, with portions cut away for clarity of illustration, of the conical shroud of the hydrocyclone of FIG. 1.
Figure 3:
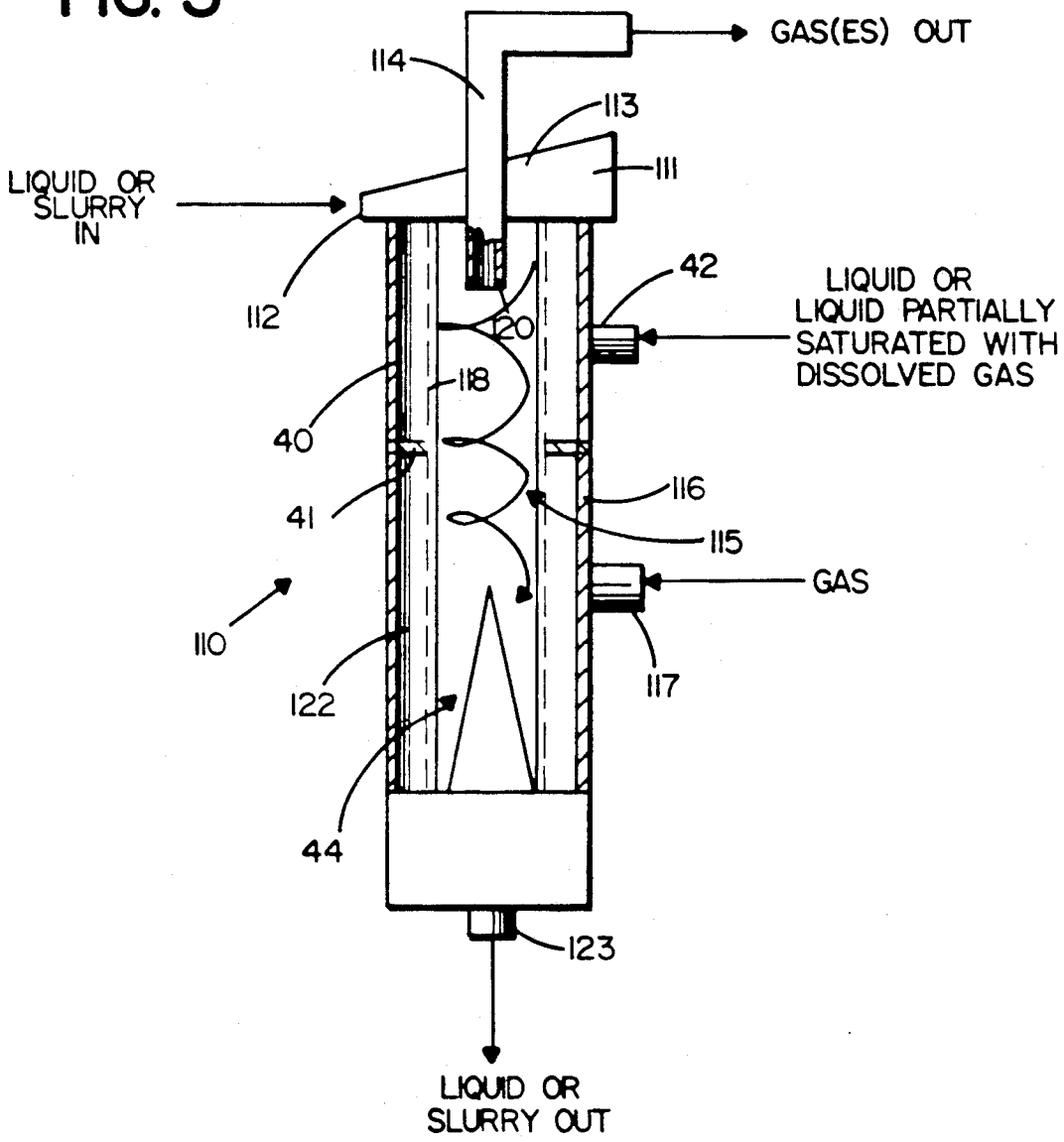
FIG. 3 is a side view, partly in cross-section and partly in elevation, of a second embodiment of hydrocyclone according to the present invention.

FIG. 3 illustrates another exemplary hydrocyclone according to the invention, having features which may be used in conjunction with the hydrocyclone 10 of FIGS. 1 and 2, or entirely separately therefrom. In the FIG. 3 embodiment components functionally comparable to those in the FIG. 1 embodiment are illustrated by the same reference numeral only preceded by a "1".

In the FIG. 3 embodiment, the main features distinguishing hydrocyclone 110 from a conventional gas sparged hydrocyclone are the separation of the annular plenum into two different portions. A bottom portion 122 of the plenum is disposed between the bottom portions of wall 116 and porous surface of revolution 118, while the top portion 40 of the plenum is separated from the bottom portion 122 by an annular solid wall 41 extending generally perpendicular to the axis of the vortex (e.g. horizontally). The porous surface of revolution 118 can be constructed so that it is both gas and liquid pervious, or it may be constructed so that the portion thereof below the wall 41 is only gas pervious (e.g. has relatively small pores), while the surface 118 above the wall 41 is both gas and liquid porous (e.g. has relatively large pores). One fluid is introduced into inlet 117 to plenum 122, while a second fluid is introduced in inlet 42 to the plenum 40. In the specific example illustrated in FIG. 3, gas is introduced into the inlet 117, while liquid—or liquid partially or completely saturated with dissolved gas, or a liquid above its boiling point—is introduced in inlet 42.

When liquid is introduced into a plenum—such as through inlet 42 into plenum 40—it is introduced at a temperature and pressure such that it undergoes a pressure drop as it passes through the porous surface of revolution 118. When it undergoes this pressure drop, gas in the form of small bubbles is released into the vortex within the body 116, formed by the fluent material being acted upon, and eventually moves toward the gas outlet 114. Utilizing this approach it is possible to produce smaller bubbles than would otherwise be possible. The production of smaller bubbles increases chemical reaction rates, absorption rates, or causes smaller particulate materials to float from the incoming liquid or slurry. Also porous media plugging problems, experienced in some applications, may be overcome.

If desired, a conventional pedestal 44—such as disclosed in U.S. Pat. No. 4,838,434—may be provided extending into the vortex from adjacent the bottom outlet 123 of the liquid or slurry.

While the hydrocyclone 110 has been described with two different plenums 40, 122, and with the liquid introduced at one end (the top) at 42 and gas introduced at the other end (e.g. bottom) at 117, it is to be understood that a plurality of different plenums may be provided with annular dividing walls 41 between each, the liquid could be introduced in the second end (bottom) and the gas at the first end (top), or just liquid or just gas could be introduced into all of the plenums (different liquids or gases would be introduced into the different plenums). Also the liquids or gases introduced into the different plenums could be chemically the same, but at different pressures and/or temperatures.

The hydrocyclone 110 has a wide variety of uses. In addition to being utilizable for separation (particularly it could be combined with the features of the hydrocyclone 10 in FIG. 1), it can be used for all of the myriad of other uses described in co-pending application Ser. No. 07/573,975 filed Aug. 28, 1990, entitled "Gas Sparged Centrifugal Separation and/or Mixing", including effecting chemical treatment of solids in a slurry with a gas chemically reactive with the slurry solids, scrubbing flue gases, chemically reacting a liquid with a gas, stripping a strippable component from a liquid utilizing a stripping gas or liquid, and absorbing a gas with an absorbable component in an absorbent liquid. Also it can be used for chemically reacting one liquid with another.

In its broadest aspect, the hydrocyclone 110 of FIG. 3 may be used in a method of treating fluent material comprising the steps of: (a) Introducing fluent material into a first end of a fluent material vortex 115 within a porous surface of revolution 118. (b) From exteriorly of the vortex (plenum 42), introducing liquid through the porous wall into the vortex so that the liquid experiences a pressure drop as it passes through the porous wall. (c) Removing any gas from the first end of the vortex (at 114). And, (d) removing treated fluent material from the second end of the vortex (at 123).

It will thus be seen that according to the present invention the versatility and/or efficiency of gas sparged hydrocyclones and related procedures have been enhanced. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A hydrocyclone, comprising:

a substantially hollow body having first and second ends, and having a wall disposed about an axis and axially elongated;

tangential inlet means for introducing fluent material into the hollow body at the first end thereof, so that the fluent material flows in a vortex within said hollow body;

first withdrawing means for withdrawing fluid from adjacent the axis at said first end of said body;

a porous surface of revolution disposed within said hollow body wall generally symmetrical with said axis;

means defining a plenum between said body wall and said porous surface of revolution;

means for introducing fluid into said plenum to pass through said porous surface of revolution into said vortex;

second withdrawing means for withdrawing fluent material from said hollow body at said second end thereof; and means for establishing further vortex action in a volume between said porous surface of revolution and said second withdrawing means to effect separation of gases from the fluent material adjacent said second withdrawing means, said means for establishing a second vortex comprises a conical end section of the hollow body extending from said porous surface of revolution to the second withdrawing means, said means for establishing a second vortex further comprises shroud means disposed above said conical end section and said shroud means extends radially outwardly form the axis of the hollow body to define a circumferential periphery, said periphery and said porous surface of revolution defining an annular opening there between, said shroud means further defining an axially located gas passage opening in the center of the shroud means for allowing passage of gas separated in said conical end section to flow toward said first withdrawal means.

2. A hydrocyclone as recited in claim 1 wherein said shroud means is mounted on a plurality of spaced legs connected between said shroud means and said conical end section.

3. A hydrocyclone as recited in claim 1 wherein said shroud means is conical, with a larger diameter adjacent said conical end section than further from said conical end section.

4. A hydrocyclone as recited in claim 1 further comprising third withdrawing means for withdrawing fluent material tangentially from said conical end section at a part thereof adjacent the end of the conical end section that extends from the porous surface of revolution.

5. A hydrocyclone as recited in claim 3 wherein said gas passage opening in the shroud means comprises a cone shaped passage opening having a larger diameter opening facing said conical end section and a smaller diameter opening facing said first end of the hollow body than further from said conical end section.

6. A hydrocyclone as recited in claim 1 further comprising wall means for dividing said plenum into at least first and second axially spaced portions; and means for introducing fluid into each of said first and second portions of said plenum.

7. A hydrocyclone as recited in claim 6 wherein said porous surface of revolution is liquid porous at least at the first plenum portion.

8. A hydrocyclone as recited in claim 7 wherein said axis is substantially vertical, and wherein said first withdrawing means is above said second withdrawing means, and said first plenum portion is above said second portion.

9. A hydrocyclone as recited in claim 8 wherein said porous surface of revolution is not liquid porous at said second portion, said introducing means comprising a first means for introducing gas into said second portion, and a second means for introducing liquid into said first portion.

10. A hydrocyclone comprising:

a substantially hollow body having first and second ends, and having a wall disposed about a vertical axis and axially elongated;

tangential inlet means for introducing fluent material into the hollow body at the first end thereof so that the fluent material flows in a vortex within said hollow body;

first withdrawing means for withdrawing fluid from adjacent the axis at said first end of said body;

a porous surface of revolution disposed within said hollow body wall generally symmetrical with said axis;

means defining a plenum between said body wall and said porous surface of revolution;

means for introducing fluid into said plenum to pass through said porous surface of revolution into said vortex;

a conical end section of said hollow body extending axially away from said porous surface of revolution at said second end of said body;

second withdrawing means for withdrawing fluent material from said body at said second end;

third withdrawing means for withdrawing fluent material tangentially from said conical end section at a part of said conical end section which is nearest to said porous surface of revolution;

shroud means disposed above said conical end section and extending radially outward from the axis of the hollow body to define a circumferential periphery, said periphery and said porous surface of revolution defining an annular flow passage there between, said shroud means further defining an axially extending passage which extends through said shroud means.

11. A hydrocyclone as recited in claim 10 wherein said shroud means is mounted on a plurality of spaced legs connected between said shroud means and said conical bottom section.

12. A hydrocyclone as recited in claim 10 wherein said shroud means is conical, with a larger diameter adjacent said conical end section than further from said conical end section.

13. A hydrocyclone as recited in claim 12 wherein said axially extending passage defined by said shroud means is conical in shape with a larger diameter opening facing said conical end section.

14. A hydrocyclone as recited in claim 10 further comprising wall means for dividing said plenum into at least first and second axially spaced portions; and means for introducing fluid into each of said first and second portions of said plenum.

15. A hydrocyclone as recited in claim 10 wherein said hollow body further comprises a solid wall extension between said porous surface of revolution and said conical and section.

* * * * *